US009046840B2

(12) United States Patent
Takahashi

(10) Patent No.: US 9,046,840 B2
(45) Date of Patent: Jun. 2, 2015

(54) IMAGE HEATING APPARATUS HAVING PRESSING MECHANISM CONFIGURED TO PRESS A FIRST UNIT TOWARD A SECOND UNIT

(71) Applicant: CANON KABUSHIKI KAISHA, Tokyo (JP)

(72) Inventor: Masahiro Takahashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/189,074

(22) Filed: Feb. 25, 2014

(65) Prior Publication Data

US 2014/0255065 A1 Sep. 11, 2014

(30) Foreign Application Priority Data

Mar. 7, 2013 (JP) ..... 2013-045096
Mar. 7, 2013 (JP) ..... 2013-045097
Mar. 7, 2013 (JP) ..... 2013-045098

(51) Int. Cl.
*G03G 15/20* (2006.01)
*G03G 21/16* (2006.01)

(52) U.S. Cl.
CPC ..... *G03G 15/206* (2013.01); *G03G 15/2032* (2013.01); *G03G 15/2067* (2013.01); *G03G 2221/1639* (2013.01); *G03G 15/2064* (2013.01); *G03G 21/1633* (2013.01); *G03G 21/1685* (2013.01)

(58) Field of Classification Search
CPC ..... G03G 15/2032; G03G 15/2035; G03G 15/2067; G03G 15/2071; G03G 21/1685; G03G 2221/1639; G03G 15/2064; G03G 15/206; G03G 21/1633
USPC ..... 399/122, 328, 329, 331; 219/216
See application file for complete search history.

(56) References Cited

U.S. PATENT DOCUMENTS

| | | | | |
|---|---|---|---|---|
| 7,483,665 | B2 * | 1/2009 | Fujiwara et al. | 399/329 |
| 7,505,713 | B2 * | 3/2009 | Lee et al. | 399/122 |
| 7,555,239 | B2 * | 6/2009 | Ito et al. | 399/122 |
| 7,647,016 | B2 * | 1/2010 | Saiki | 399/329 |
| 7,974,563 | B2 | 7/2011 | Sakai et al. | |
| 8,005,413 | B2 | 8/2011 | Sakakibara et al. | |

(Continued)

FOREIGN PATENT DOCUMENTS

| | | | |
|---|---|---|---|
| JP | 04257886 A | * | 9/1992 |
| JP | 8-328406 A | | 12/1996 |

(Continued)

*Primary Examiner* — Robert Beatty
(74) *Attorney, Agent, or Firm* — Fitzpatrick, Cella, Harper & Scinto

(57) ABSTRACT

An image heating apparatus includes: first and second rotatable members configured to form a nip for heating of a toner image on a sheet; a first unit configured to rotatably hold the first rotatable member; a second unit configured to rotatably hold the second rotatable member; and a pressing mechanism configured to press the first unit toward the second unit. The pressing mechanism includes: an abutting member capable of abutting against the first unit; an arm member, including a supporting portion configured to be rotatably supported by the abutting member, capable of abutting against the abutting member; and a spring member which is fixed to the second unit at one end portion thereof and which is mounted, at another and portion thereof, to the arm member at a position closer to a free end of the arm member than the supporting portion of the arm member.

19 Claims, 12 Drawing Sheets

(56) References Cited

U.S. PATENT DOCUMENTS

| | | | | |
|---|---|---|---|---|
| 8,224,223 | B2 | 7/2012 | Sakakibara et al. | |
| 8,369,763 | B2 | 2/2013 | Sakakibara et al. | |
| 8,385,800 | B2 * | 2/2013 | Masuda et al. | 399/328 |
| 8,401,450 | B2 | 3/2013 | Sekihara et al. | |
| 8,577,269 | B2 | 11/2013 | Takahashi | |
| 8,626,046 | B2 | 1/2014 | Sekihara et al. | |
| 8,824,925 | B2 * | 9/2014 | Sugaya et al. | 399/122 |
| 2012/0051806 | A1 | 3/2012 | Takahashi | |
| 2012/0170957 | A1 * | 7/2012 | Lim et al. | 399/331 |
| 2013/0051875 | A1 | 2/2013 | Takahashi | |
| 2013/0202334 | A1 | 8/2013 | Takahashi | |
| 2013/0319825 | A1 | 12/2013 | Takahashi | |
| 2013/0330103 | A1 | 12/2013 | Takahashi | |
| 2014/0105633 | A1 | 4/2014 | Takahashi | |
| 2014/0105634 | A1 | 4/2014 | Tanaka et al. | |

FOREIGN PATENT DOCUMENTS

| | | | |
|---|---|---|---|
| JP | 09212030 | A * | 8/1997 |
| JP | 2009053294 | A * | 3/2009 |

* cited by examiner

IMAGE HEATING APPARATUS HAVING PRESSING MECHANISM CONFIGURED TO PRESS A FIRST UNIT TOWARD A SECOND UNIT

FIELD OF THE INVENTION AND RELATED ART

The present invention relates to an image heating apparatus for heating a toner image on a sheet.

As a constitution of an image forming apparatus such as a copying machine, a printer, facsimile machine or a multi-function machine of these machines, a constitution in which the toner image is formed by using an appropriate image forming process such as an electrophotographic process or an electrostatic recording process has been conventionally known. Further, the toner image formed by such an image forming process is transferred onto a recording material (sheet). The recording material on which the toner image is transferred is heated and pressed by a fixing device as the image heating apparatus, so that the toner image is fixed on the recording material.

Such a fixing device is provided with a pair of rotatable members, and a constitution in which one of the rotatable members is pressed toward another one of the rotatable members to form a nip for permitting heating of the recording material is employed.

Here, in order to apply a proper pressure at the nip, a constitution in which one rotatable member is pressed toward another rotatable member by a spring member has been proposed in Japanese Laid-Open Patent Application (JP-A) Hei 8-328406. In a fixing device described in JP-A Hei 8-328406, a constitution in which lock is made by using a locking mechanism for maintaining the pressed state is employed.

However, in the case where such a locking mechanism is used, complication of the fixing device cannot be avoided.

SUMMARY OF THE INVENTION

According to an aspect of the present invention, there is provided an image heating apparatus comprising: (i) first and second rotatable members configured to form a nip for heating of a toner image on a sheet; (ii) a first unit configured to rotatably hold the first rotatable member; (iii) a second unit configured to rotatably hold the second rotatable member; and (iv) a pressing mechanism configured to press the first unit toward the second unit, wherein the pressing mechanism comprises: (iv-i) an abutting member capable of abutting against the first unit; (iv-ii) an arm member, including a supporting portion configured to be rotatably supported by the abutting member, capable of abutting against the abutting member; and (iv-iii) a spring member which is fixed to the second unit at one end portion thereof and which is mounted, at another and portion thereof, to the arm member at a position closer to a free end of the arm member than the supporting portion of the arm member.

According to another aspect of the present invention, there is provided an image heating apparatus comprising: (i) first and second rotatable members configured to form a nip for heating of a toner image on a sheet; (ii) a first unit configured to rotatably hold the first rotatable member; (iii) a second unit configured to rotatably hold the second rotatable member; and (iv) a pressing mechanism configured to press each of longitudinal end portions of the first unit toward the second unit, wherein the pressing mechanism comprises: (iv-i) a first abutting member capable of abutting against one of the longitudinal end portions of the first unit; (iv-ii) a first arm member, including a first supporting portion configured to be rotatably supported by the first abutting member, capable of abutting against the first abutting member; (iv-iii) a first spring member which is fixed to the second unit at one end portion thereof and which is mounted, at another and portion thereof, to the first arm member at a position closer to a free end of the first arm member than the first supporting portion of the first arm member; (iv-iv) a second abutting member capable of abutting against another one of the longitudinal end portions of the first unit; (iv-v) a second arm member, including a second supporting portion configured to be rotatably supported by the second abutting member, capable of abutting against the second abutting member; and (iv-vi) a second spring member which is fixed to the second unit at one end portion thereof and which is mounted, at another and portion thereof, to the second arm member at a position closer to a free end of the second arm member than the first supporting portion of the second arm member.

These and other objects, features and advantages of the present invention will become more apparent upon a consideration of the following description of the preferred embodiments of the present invention taken in conjunction with the accompanying drawings.

DESCRIPTION OF THE EMBODIMENTS

An embodiment to which the present invention is applicable will be described with reference to FIGS. 1 to 12. First, a general structure of an image forming apparatus including a fixing device as an image heating apparatus, provided with a pressing mechanism, according to this embodiment will be described with reference to FIG. 1.

[Image Forming Apparatus]

Figure 1:
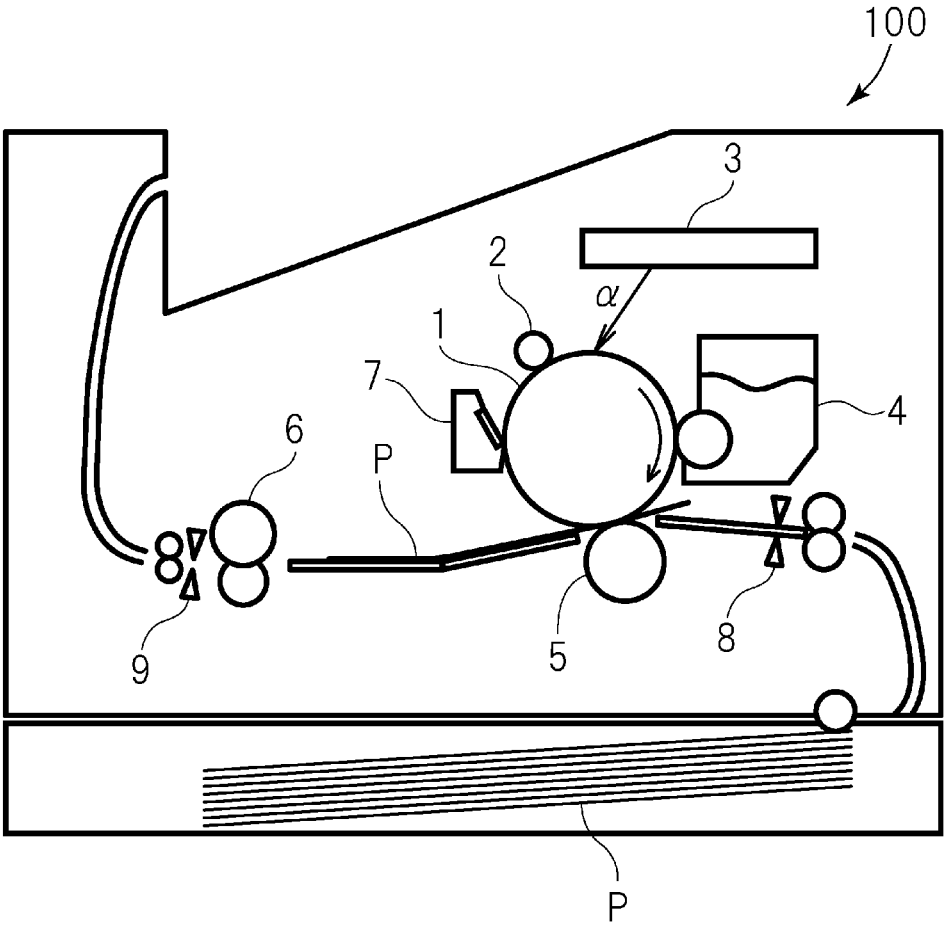
FIG. 1 is a schematic sectional view of an image forming apparatus.

An image forming apparatus 100 includes a photosensitive drum (photosensitive member) as an image bearing member as shown in FIG. 1. The photosensitive drum 1 is constituted by forming, on a cylindrical substrate of aluminum or nickel, a layer of photosensitive material such as an organic photoconductor (OPC), amorphous Se or amorphous Si.

The photosensitive drum 1 is rotationally driven in an arrow direction shown in FIG. 1 and at first, a surface thereof is electrically charged uniformly by a charging roller 2 as a charging means. Next, the photosensitive drum surface is subjected to scanning exposure to a laser beam α ON/OFF-controlled depending on image information by a laser scanner 3 as an exposure means, so that an electrostatic latent image is formed. This electrostatic latent image is developed and visualized by the developing device 4. As a developing method, a jumping developing method, a two-component developing method, a FEED developing method (contact developing method using a one-component insulating toner) or the like is used, and in many cases, image exposure and reverse development are used in combination.

The visualized toner image is transferred from the photosensitive drum 1 onto a recording material P fed at predetermined timing by a transfer roller 5 as a transfer means. Here, a leading end of the recording material P is detected by a sensor 8 so that an image forming position of the toner image on the photosensitive drum 1 and a writing start position of the leading end of the recording material P coincide with each other, thus adjusting timing.

The recording material P fed at predetermined timing is nipped and fed at a certain pressing force (pressure) by the photosensitive drum 1 and the transfer roller 5. The recording material P no which the toner image is transferred is fed into a fixing device 6 as an image heating apparatus, so that the toner image is fixed as an image.

On the other hand, a transfer residual toner remaining on the photosensitive drum 1 is removed from the surface of the photosensitive drum 1 by a cleaning device 7. Further, in the fixing device 6, a discharge sensor 9 for detecting the leading end of the recording material P is provided and detects paper jam when the recording material P causes the paper jam between the sensor 8 and the discharge sensor 9.

[Fixing Device]

Next, with reference to FIGS. 2 and 3, a general structure of the fixing device 6 as the image heating apparatus will be described. The fixing device 6 includes a fixing assembly 10 for heating the image carried on the recording material P, an opposite roller 20 as a rotatable member (nip-forming member) for forming a nip N where the recording material P is to be sandwiched between the opposite roller 20 and the fixing assembly 10, and a pressing device 200 described specifically later. The fixing assembly 10 is a unit for rotatably holding a fixing film 13 as a rotatable member.

The fixing assembly 10 is a member-to-be-pressed to be pressed by the pressing device 200 and includes the fixing film 13, a (heating) heater 11 as a heating mechanism, a heating-insulating holder 12 for holding the heater 11, and a metal stay 14. Here, the metal stay 14 receives a pressing (urging) force by a pressing spring 15 as an urging means via a pressing arm 23 as an abutting member (pressing member) and a flange 16 to press the heat-insulating holder 12 toward the opposite roller 20.

The heater 11 is a ceramic heater formed in a plate shape and generates heat by supply of electric power (energy). The heat-insulating holder 12 for holding the heater 11 is formed of a heat-resistant resin material such as a liquid crystal polymer, a phenolic resin, PPS (polyphenylene sulfide) or PEEK (polyether ether ketone). A degree of heat conduction to the opposite roller 20 is better with a decreasing thermal conductivity, and therefore a filler such as a glass balloon or a silica balloon may also be incorporated into a layer of the resin material. Further, the heat-insulating holder 12 also has the function of guiding rotation of the fixing film 13. The metal stay 14 contacts the heat-insulating holder 12, thus suppressing flexure and torsion of the fixing assembly as a whole.

[Fixing Film]

The fixing film 13 is a heat-resistant film having a total thickness of 200 μm or less in order to enable quick start of the image forming apparatus. Such a fixing film 13 is prepared by forming a base layer of a heat-resistant resin material such as polyimide, polyamideimide, PEEK; or metal or alloy having a heat-resistance property and a high thermal conductivity, such as SUS (stainless steel), Al, Ni, Cu, Zn, or the like.

In the case of the resin-made base layer, in order to improve the thermal conductivity, high thermal conductivity powder of BN, alumina, Al or the like may also be mixed. Further, in order to constitute a long-lifetime fixing apparatus, as the fixing film 13 which has a sufficient strength and which is excellent in durability, the total thickness may preferably be 20 μm or more. Accordingly, the total thickness of the fixing film 13 in the range of 20 μm or more and 200 μm or less is optimum.

Further, in order to ensure an offset preventing property and a recording material separating property, as a surface layer, a parting layer of a heat-resistant resin, having a good parting property, including a fluorine-containing resin such as PTFE, PFE, FEP, ETFE, CTFE or PDV; silicone resin; and the like. These resins are used singly or in mixture. In this embodiment, the surface (parting) layer is constituted by a material at least containing PTFE and PFA.

Here, PTFE is polytetrafluoroethylene, PFA is tetrafluoroethylene-perfluoroalkylvinyl ether copolymer, FEF is tetrafluoroethylene-hexafluoropropylene copolymer, ETFE is ethylene-tetrafluoroethylene copolymer, CTFE is polychlorotrifluoroethylene, and PVDF is polyvinylidene fluoride.

As a coating method, dipping of the parting layer after etching of the outer surface of the fixing film 13, application such as powder spraying, a method in which the surface of the fixing film 13 is coated with a tube-like resin material, or a method in which the outer surface of the fixing film 13 is blasted and thereafter a primer layer of an adhesive is applied and then the parting layer is coated on the primer layer may be used.

[Opposite Roller]

The opposite roller 20 is an elastic roller prepared by forming an elastic layer 22, such as an elastic solid layer, an elastic sponge rubber layer or an elastic foam rubber layer, outside a core metal 21 of SUS, SUM (sulfur or sulfur complex free-cutting steel material), Al or the like. Here, the elastic solid rubber layer is formed with a heat-resistant rubber such as a silicone rubber or a fluorine-containing rubber. The elastic sponge rubber layer is formed by foaming the silicone rubber in order to provide a further heat-insulating effect. Further, the elastic foam rubber layer is formed by dispersing a hollow filler (microballoon or the like) in a silicone rubber layer and by incorporating a gas component in a cured material to enhance the heat-insulating effect. On the surface of the elastic layer 22, a parting layer of perfluoroalkoxy resin (PFA), polytetrafluoroethylene resin (PTFE) or the like may also be formed.

[Drive and Control of Fixing Device]

The fixing assembly 10 is pressed toward the opposite roller 20 against elasticity of the opposite roller 20 by the pressing device 200 described later to form the nip N. At the nip N, the fixing film 13 is sandwiched between the heater 11 and the opposite roller 20 by the pressing force to be flexed, thus being placed in a state in which the fixing film 13 closely contacts a heating surface of the heater 11.

Figure 2:
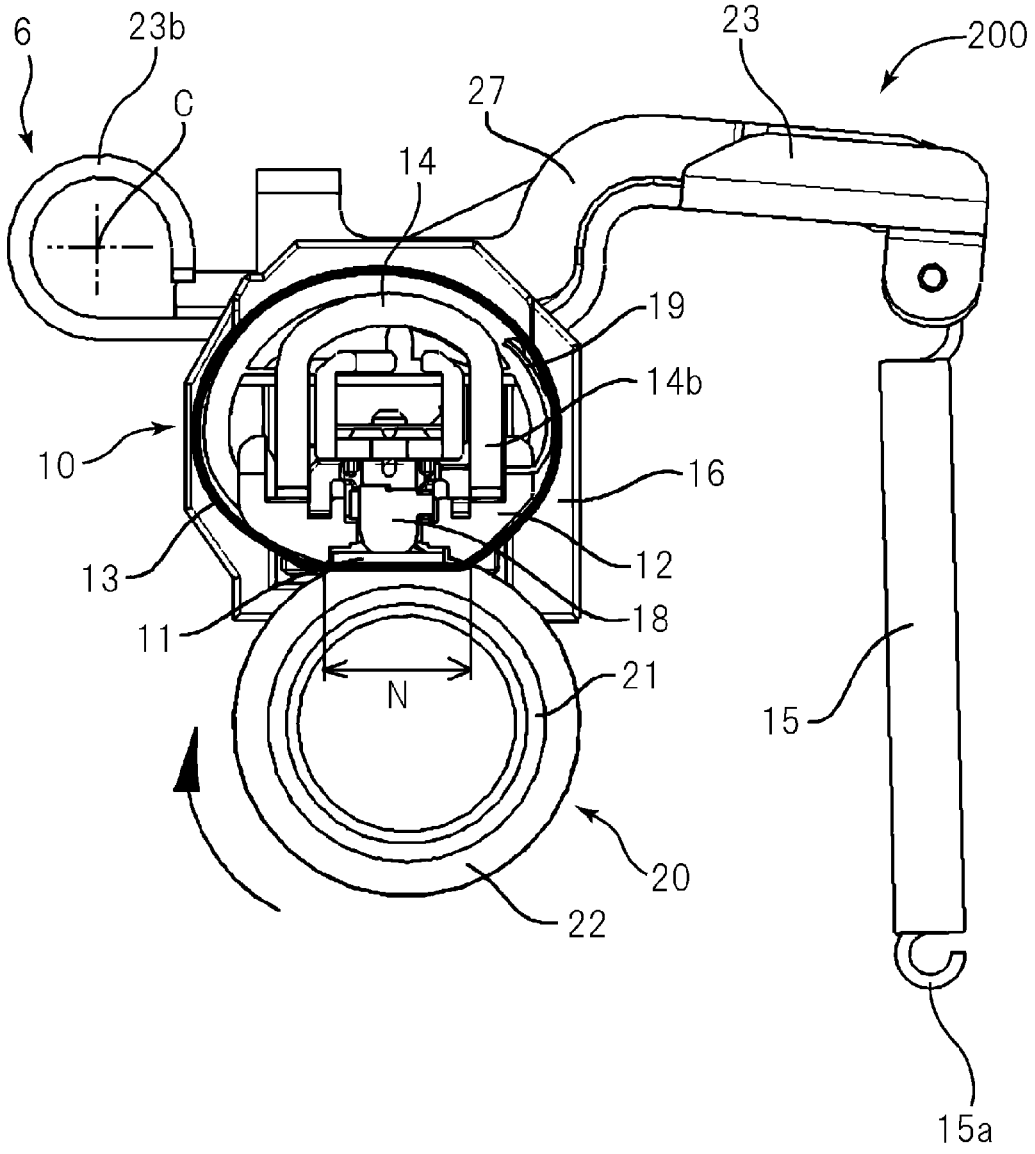
FIG. 2 is a sectional view showing a part of a fixing device.
Figure 3:
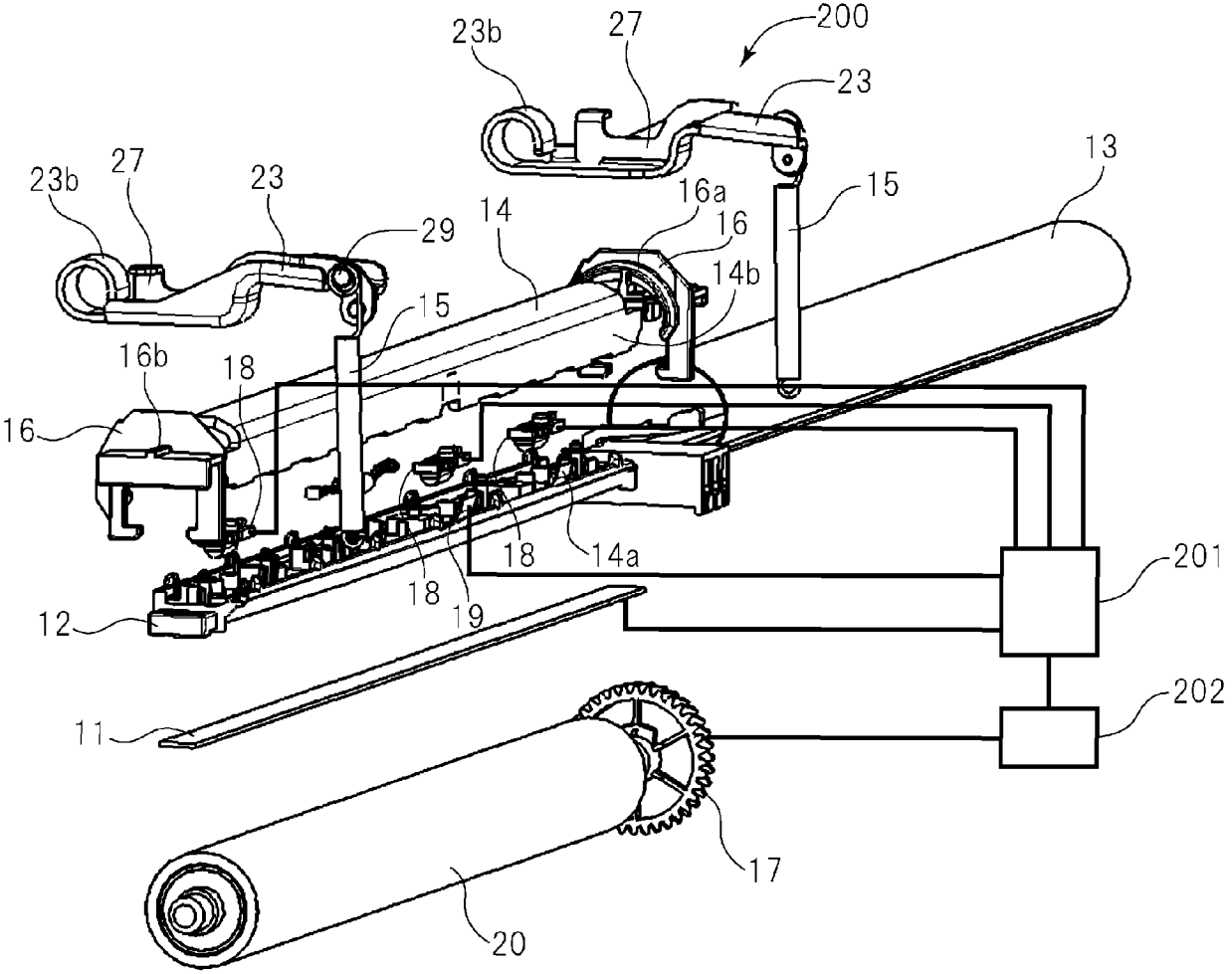
FIG. 3 is a perspective view showing the part of the fixing device.

The opposite roller 20 obtains a driving force, for rotating in an arrow direction in FIG. 2, by a driving gear 17 provided at an end portion of the core metal 21 as shown in FIG. 3. The driving force is transmitted by a motor 202 as a driving means in accordance with an instruction from a controller (CPU) 201 as a control means. Incidentally, the controller 201 is also used as a controller for the image forming apparatus 100, but the fixing device 6 itself includes the controller.

With rotational drive of the opposite roller 20, the fixing film 13 is rotated (moved) by a frictional force with the opposite roller 20. At this time, the fixing film 13 slides with the heater 11. Between the fixing film 13 and the heater 11, a lubricant such as heat-resistant grease of a fluorine-type or a silicone-type is disposed, so that a frictional resistance is suppressed to a low level and thus the fixing film 13 is smoothly rotatable (movable).

Further, temperature control of the heater 11 is effected by determining, on the basis of a signal of a temperature detecting element such as a thermistor, a duty ratio or wave number or the like of a voltage, to be applied to an energization heat generating resistance layer of the heater 11, by the controller 201. Further, the temperature in the nip N is maintained at a desired fixing set temperature. Here, various thermistors used for the temperature control are a thermistor 18 provided on a back surface of the ceramic substrate and a thermistor 19 provided on an inner surface of the fixing film 13, for directly detecting the temperature of the fixing film 13.

Further, the metal stay 14 is provided with a grounding member 14*a* for the purpose of ensuring grounding with the fixing film 13. The grounding member 14*a* and the thermistor 19 elastically slidably contact the inner surface of the fixing film 13 in a state in which the fixing film 13 is mounted. For this reason, the grounding member 14*a* and the thermistor 19 are provided with a member, such as a metal plate, having a spring property and are mounted so that an end thereof is projected to an outside of a projected shape of the fixing film 13 during mounting of the fixing film 13 in a natural state while possessing the spring property.

As described above, the recording material P holding the (unfixed) toner image is nipped and fed at the nip N, so that the toner image is heat-fixed on the recording material P. The recording material P discharged from the nip N is guided by an unshown discharging guide to be discharged.

[Pressing Device]

Next, the pressing device 200 for pressing the fixing assembly 10 as the member-to-be-pressed will be described with reference to FIGS. 2 to 5. The pressing device 200 includes a casing 25, an openable cover 24 as a cover member, a pressing arm 23 was a pressing member, and a pressing spring 15 as a spring member (urging member). The casing 25 is a unit for rotatably holding the opposite roller 20 and is provided with an opening 25*a* for permitting mounting and demounting of the fixing assembly 10, the opposite roller 20 and the like. Such a casing 25 includes a pair of supporting plates 25*b* between which the fixing assembly 10 and the opposite roller 20 are accommodated and disposed and are supported at end portions thereof.

Figure 4:
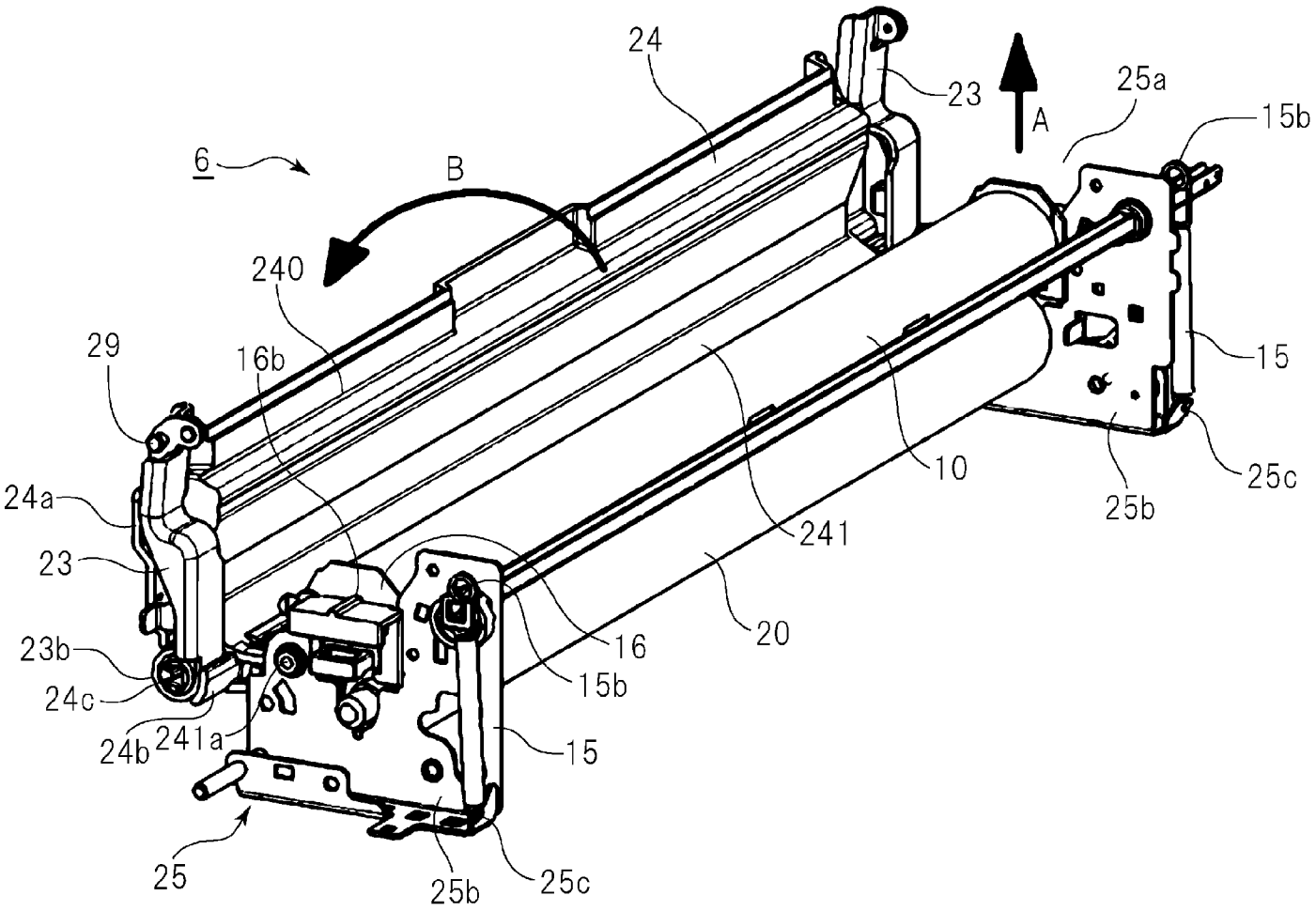
FIG. 4 is a perspective view showing a state in which a cover of the fixing device is open.
Figure 5:
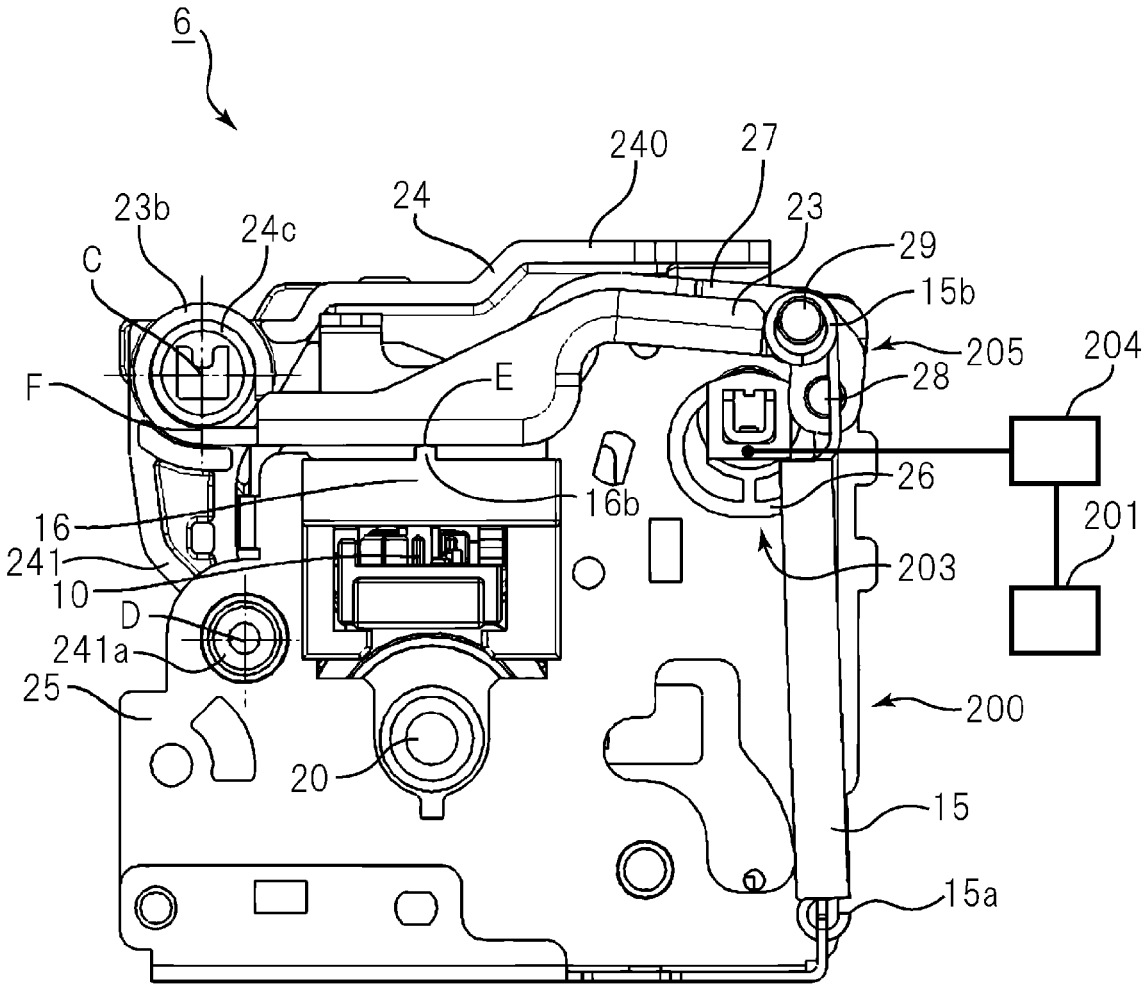
FIG. 5 is a sectional view of the fixing device during pressing by a pressing arm.

The openable cover 24 is supported, by the casing 25, rotatably relative to the casing 25 between a shielding (closing) position (position of FIG. 5) where the openable cover 24 covers the opening 25*a* of the casing 25 and an open position (position of FIG. 4) where the opening 25*a* is open. Such an openable cover 24 includes a covering portion 240 for covering the opening 25*a* and a bent portion 241 formed so as to be bent from a base end side of the covering portion 240 toward the casing 25 side. Further, a rotation shaft 241*a* provided at an end portion of the bent portion 241 in an opposite side to the covering portion 240 is rotatably supported by each of the pair of supporting plates 25*b* of the casing 25. As a result, the openable cover 24 is supported by the casing rotatably about a rotation center D (FIG. 5).

The pressing arm 23 is supported by the openable cover 24 so as to be rotatable in one end side within a predetermined angle range. Further, the pressing arm 23 is also rotatable integrally with the openable cover 24. Further, the pressing arm 23 is positioned at a pressing position (position of FIG. 5) where the pressing arm 23 is capable of applying the pressing force to the fixing assembly 10 at the shield position of the openable cover 24.

In this embodiment, the pressing arm 23 is rotatably by the openable cover 24 at the base end portion thereof in one end side. For this reason, the pressing arm 23 is provided with a cylindrical rotatable portion 23*b* at the base end portion thereof, and the covering portion 240 of the openable cover 24 is provided with a rotation supporting portion (boss) 24*c* at each of base end-side end portions thereof. Further, the rotatable portion 23*b* is rotatably engaged with the rotation supporting portion 24*c*, so that the pressing arm 23 is held by the openable cover 24 so as to be rotatable about a rotation center C (FIGS. 2 and 5).

Further, the openable cover 24 is provided with a first limiting portion 24*a* and a second limiting portion 24*b* which are used as a stopper (rotation stopping portion) for limiting relative rotation between the pressing arm 23 and the openable cover 24 (for limiting rotation in a distance exceeding the predetermined angle range). The first limiting portion 24*a* is formed, at each of end portions of the covering portion 240 of the openable cover 24, so as to cover the pressing arm 23 in a rotation side toward an open direction (arrow B direction in FIG. 4) of the pressing arm 23. Further, in the case where the pressing arm 23 is rotated in the open direction, a part of the pressing arm 23 and the first limiting portion 24*a* contact each other, so that the first limiting portion 24*a* limits rotation of the pressing arm 23 in the open direction relative to the openable cover 24. That is, with the rotation of the pressing arm 23 in the open direction, the openable cover 24 is rotated in the open direction together with the pressing arm 23.

On the other hand, the second limiting portion 24*b* is projected, at a central portion of the bent portion 241 of the openable cover 24, so as to cover the base of the pressing arm 23 in a rotation side toward a shield direction (direction opposite to the arrow B direction in FIG. 4) of the pressing arm 23. Further, in the case where the pressing arm 23 is rotated in the shield direction, a part of the pressing arm 23 and the second limiting portion 24*b* contact each other, so that the first limiting portion 24*a* limits rotation of the pressing arm 23 in the shield direction relative to the openable cover 24. That is, with the rotation of the pressing arm 23 in the shield direction, the openable cover 24 is rotated in the shield direction together with the pressing arm 23.

In the case of this embodiment, by providing a gap between the pressing arm 23 and each of the first and second limiting portions 24*a* and 24*b*, the openable cover 24 and the pressing arm 23 are somewhat rotatable relative to each other. Incidentally, such a rotation stopping portion for limiting the relative rotation can also have another constitution such that, e.g., the pressing arm 23 is supported by the openable cover 24 in a non-rotatable manner (or in a somewhat rotatable manner).

The pressing spring 15 is fixed to the pressing arm 23 at one end thereof and is fixed to the casing 25 at another end thereof, and urges the pressing arm 25 in an application direction (pressing direction) of a pressing force (urging force). In this embodiment, the pressing spring 15 is a tension spring connected, at one end portion thereof, with an engaging hole 25*c* as a casing-side connecting portion provided in the casing 25 and, at another end portion thereof, with a projected portion (boss) 29 as a rotatable portion-side connecting portion in the pressing arm 23 side. In this embodiment, the pressing spring 15 is coil spring. That is, a one end portion-side hooking portion 15*a* formed at the one end portion of the pressing spring 15 is hooked in the engaging hole 25*a* of the casing 25, and another end portion-side hooking portion 15*b* formed in a ring (loop) shape at another end portion of the pressing spring 15 is hooked on the projected portion 29. Thus, the pressing spring 15 is disposed, between the engaging hole 25*c* and the projected portion 29, in a state in which the pressing spring 15 is elastically elongated from a free state, so that the pressing arm 23 is urged in the pressing direction. Incidentally, the projected portion 29 constitutes a releasing (eliminating) mechanism 205 as a releasing (eliminating) means as described later, and is provided in a projected manner on a releasing arm 27 as an arm member rotatably supported at a supporting portion 28 by the pressing arm 23. Further, the projected portion 29 is disposed at a position closer to a free end (portion W shown in FIG. 11), as an end of the releasing arm 27 with respect to an extension direction, than the supporting portion 28 of the releasing arm 27. Further, at the free end portion W of the releasing arm 27, a grip portion is provided.

Further, the pressing arm 23 can be freely connected with and demounted from another end portion of the pressing spring 15 connected with the casing 25 at the one end portion of the pressing spring. That is, the another end portion-side hooking portion 15*b* of the pressing spring 15 is pulled off from the projected portion 29 in the pressing arm 23 side, so that the pressing arm 23 can be demounted from another end portion of the pressing spring 15. Further, by inserting the projected portion 29 into the another end portion-side hooking portion 15*b*, the pressing arm 23 can be connected another end portion of the pressing spring 15. Incidentally, such connection and demounting between the pressing spring 15 and the pressing arm 23 can be performed by using a tool such as a plier even in a state in which the pressing spring 15 is pressed. However, in this embodiment, as described later, the connection and the demounting are performed in a state in which the pressing force by the pressing spring 15 is released (eliminated) or reduced.

The fixing assembly O is supported at each of end portions thereof by a flange 16. That is, an arcuate guiding portion 16*a* formed so as to be projected from an inside surface of the flange 16 is inserted into the fixing film 13 from the end portion of the fixing film 13, so that the fixing 13 is rotatably supported by the guiding portion 16*a* provided on the flange 16 at each of the end portions thereof. These flanges 16 provided at the end portions are connected by the metal stay 14. Accordingly, by the flanges 16 provided at the end portions, the metal stay 14, the heat-insulating holder 12 supported by the metal stay 14, the heater 11 held by the heat-insulating holder 12, and the like are supported. Further, the flanges 16 provided at the end portions are detachably mounted to the pair of supporting plates of the casing 25 and are mounted so as to be freely movable toward and away from the opposite roller 20. Further, on each of outside surfaces of the flanges 16 provided at the end portions, a contact receiving portion 16*b* contactable with the pressing arm 23 at the pressing position is provided in a projected manner.

The thus-constituted pressing device 200 applies the pressing force to the fixing assembly 10 via the flanges 16 by the contact of the pressing arm 23 with the contact receiving portion 16*b* of the flange 16. That is, the pressing spring 15 is connected with the casing 25 at one end portion thereof and is connected with the pressing arm 23 at another end portion thereof. Further, the pressing arm 23 is held rotatably about the rotation center C and is urged by the pressing spring 15 at one end portion thereof, so that the pressing arm 23 contacts the contact receiving portion 16*b* of the flange 16 at the pressing position. Further, the pressing arm 23 applies the urging force to the flange 16, thus pressing the flange 16 toward the opposite roller 20. The urging force transmitted to the flanges 16 acts on the end portions of the metal stay 14, and as a result thereof, the metal stay 14 is pressed toward the opposite roller 20. As a result, the heat-insulating holder 12 disposed in contact with the metal stay 14 and the heater 11 disposed in contact with the heat-insulating holder 12 are integrally pressed toward the urging 20.

Here, as shown in FIG. 3, the metal stay 14 is projected from the heat-insulating holder 12 at longitudinal end portions thereof and is inserted into the flanges 16, so that the pressing arms 23 disposed on the flanges 16 are pressed by the pressing springs. As a result, a load by the pressing spring 15 is uniformly transmitted over the longitudinal direction of the heat-insulating holder 12 via a stay foot portion 14*b* contacting the heat-insulating holder 12 of the metal stay 14. In this way, the metal stay 14, the heat-insulating holder 12 and the heater 11 are pressed by the pressing springs 15, so that the fixing film 13 is sandwiched between the opposite roller 20 and a structure including the heat-insulating holder 12 and the heater 11 to form the nip N.

[Mounting and Demounting of Fixing Assembly with Respect to Casing]

Next, with reference to FIGS. 4 and 5, a constitution for mounting and demounting the fixing assembly 10 with respect to the casing 25 will be described. The fixing assembly 10 is detachably mounted to the casing 25 in an arrow A direction in FIG. 4 through the opening 25*a* provided in the casing 25. To the casing 25, the openable cover 24 is rotatably mounted, and the openable cover 24 is rotated in an arrow B direction of FIG. 4, so that the opening 25*a* of the casing 25 is exposed (opened) to place the fixing assembly 10 in a detachably mountable state.

Here, the pressing arm 23 for pressing the fixing assembly 10 toward the opposite roller 20 is rotatably supported by the rotation supporting portion 24*c* provided on the openable cover 24. Further, by disconnecting the pressing spring 15 connected to another end portion of the pressing arm 23, the pressing arm 23 is rotatable to the open position integrally with the openable cover 23. In other words, the pressing arm 23 and the openable cover 24 are capable of being retracted from a locus with respect to a demounting direction of the fixing assembly 10 when the fixing assembly 10 is demounted in the arrow A direction. That is, the pressing arm 23 is demounted from another end portion of the pressing spring 15 and then is rotated in an arrow C direction about the rotation center C. Then, the pressing arm 23 contacts the first limiting portion 24*a* of the openable cover 24, so that the openable cover 24 is rotated together with the pressing arm 23 in the arrow B direction, i.e., the open direction. As a result, the opening 25*a* is exposed, so that the fixing assembly is detachably mountable.

On the other hand, during use of the fixing device 6, in a state in which the fixing assembly 10 is mounted in the casing 25, the openable cover 24 is rotated in a direction opposite to the arrow B direction to cover the opening 25*a*. At this time, the pressing arm 23 is rotated together with the openable cover 24 by the second limiting portion 24*b* in the direction opposite to the arrow B direction, so that the openable cover 24 is positioned at the shield position. At this position, the pressing spring 15 is connected with the end of the pressing arm 23 to place the pressing arm 23 at the pressing position as shown in FIG. 5, so that a force from the pressing spring 15 is transmitted to the fixing assembly 10 via the pressing arm 23 to press the fixing assembly 10 toward the opposite roller 20. Further, the openable cover 24 is fixed at the shield position in a state in which the pressing arm 23 is connected with the pressing spring 15 as described above.

[Fixing Openable Cover]

Figure 6:
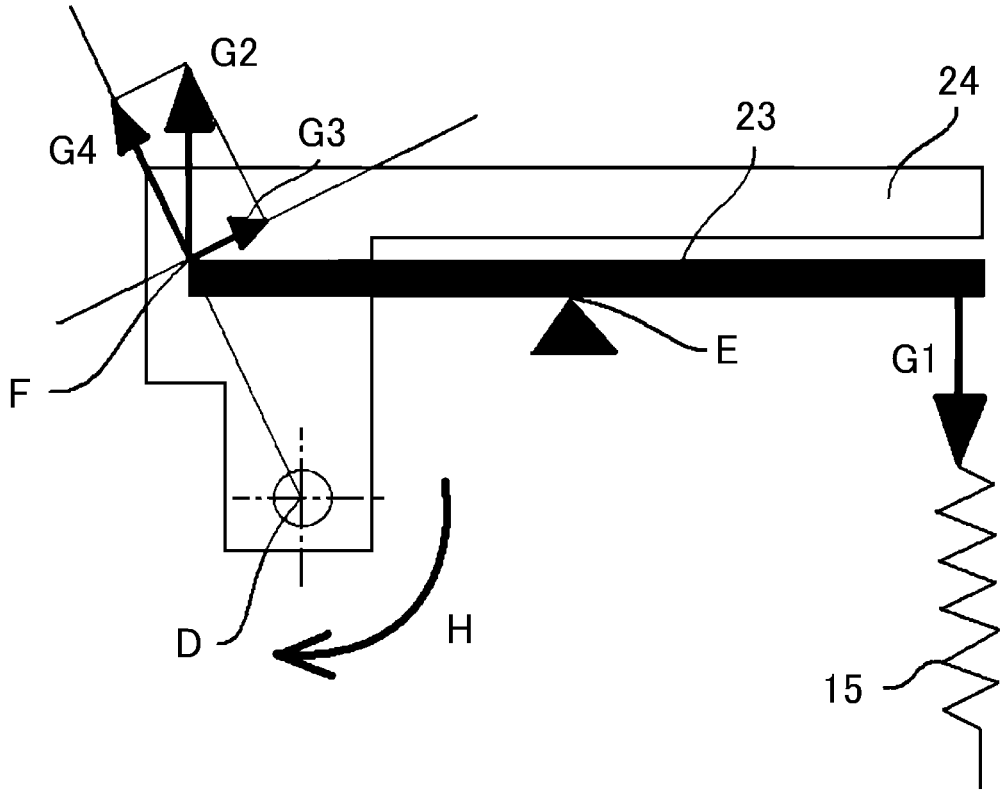
FIG. 6 is a schematic view showing action of a force at a pressing position of the pressing arm.

Next, with reference to FIGS. 5 and 6, a mechanism for fixing the contact 24 at the shield position (i.e., a mechanism in which the openable cover 24 is maintained at the shield position without using the lock mechanism as used in the conventional constitution) will be described. FIG. 6 schematically shows a force acting on the pressing arm 23 and the openable cover 24. First, as shown in FIG. 6, in a state in which an urging force G1 by the pressing spring 15 acts on the pressing arm 23, a contact portion (point) between the pressing arm 23 and the contact receiving portion 16*b* of the flange 16 is taken as point E. Further, a force acting from the pressing arm 23 onto the openable cover 24 with the point E as a fulcrum by the urging force G1 is taken as G2. At this time, a position of the rotation center D of the openable cover 24 is set to that moment H in a direction toward the shield position is applied to the openable cover 24 by the force G2 with, as a center, the rotation center relative to the casing 25.

For this reason, in the case of this embodiment, the position of the rotation center D of the openable cover 24 is set so as to satisfy the following condition. First, a point where the urging force G1 acts from the pressing arm 23 onto the openable cover 24 with the point E as the fulcrum is taken as application point F. In this case, the rotation center D of the openable cover 24 is positioned relative to the openable cover 24 in an acting direction of the urging force G1 and is also positioned in the fulcrum side (point E side) with respect to the application point F. In other words, the rotation center D is positioned in the shield position side (lower side in FIG. 6) than the openable cover 24 and is disposed between the application point F and the point E. This will be specifically described below.

In general, during operation of the image forming apparatus, in order to form the nip N, in the fixing device 6, the urging force from the pressing spring 15 is transmitted to the fixing assembly 10, so that the fixing assembly 10 is press-contacted to the opposite roller 20. At this time, the urging force of the pressing spring 15 acts on one end of the pressing arm 23 to apply moment about the rotation center C to the pressing arm 23. The moment applied to the pressing arm 23 is transmitted as an urging force for urging (pressing) the flange 16, contacting the pressing arm 23 at the point E, toward the opposite roller 20, and as a result, the fixing assembly 10 is pressed toward the roller 20.

Further, the pressing arm 23 is rotatably connected with the openable cover 24. For this reason, when the point E as the contact point between the pressing arm 23 and the flange 16 is the fulcrum and the connecting portion (point) with the pressing spring 15 is a force application point (power point), at a point F as a contact portion (point) between the openable cover 24 and the pressing arm 23, the urging force corresponding to the application point in the principle of leverage is generated. At this time, a relationship between forces exerted on respective portions is as shown in FIG. 6.

That is, the pressing arm 23 is connected with the pressing spring 15 at one end of thereof and is connected with the openable cover 24 at another end thereof. When the urging force G1 is applied to the pressing arm 23 in the arrow direction in FIG. 6 by the pressing spring 15, the pressing arm 23 applies the urging force G2 in the arrow direction in FIG. 6 to the application point F on the openable cover 24 with the point E as the fulcrum. The openable cover 24 is rotatably supported about the rotation center D by the casing 25, and therefore the urging force G2 applied to the openable cover 24 is replaced with moment G3 and normal reaction G4, shown by the arrows in FIG. 6, acting on the openable cover 24. The openable cover 24 has the constitution in which the openable cover 24 is rotatable about the rotation center D, so that by the moment G3, moment (rotational force) H in the arrow direction in FIG. 6 acts on the openable cover 24. By the action of this force, the openable cover 24 is urged in a direction (toward the shield position) in which the openable cover 24 covers the opening 25*a* of the casing 25 only by connecting the pressing spring 15 with the pressing arm 23. As a result, the openable cover 24 can be maintained at the shield position without separately using a fastening mechanism or a lock mechanism which are used for fastening the openable cover 24 to the casing 25.

[Pressing (Force) Adjusting Mechanism]

Next, with reference to FIGS. 7 and 8, a pressing (force) adjusting mechanism 203 as a means (spacing mechanism) for adjusting the pressing force to be applied to the fixing assembly 10 will be described. The pressing adjusting mechanism 203 adjusts the pressing force to be applied to the fixing assembly 10 by moving the pressing arm 23 positioned at the pressing position in a direction opposite to the pressing force application direction. For this purpose, the pressing adjusting mechanism 203 includes an adjusting cam 26 as a contact member for moving the pressing arm 23 in contact with the pressing arm 23, and a motor 204 as a driving means for rotationally driving the adjusting cam 26.

The adjusting cam 26 has an outer peripheral surface having different distances from the rotation center thereof, and changes the position of the outer peripheral surface contacting the pressing arm 23, so that the adjusting can 26 moves the pressing arm 23. Specifically, the adjusting cam 26 is rotatably supported by the casing 25, in the neighborhood of the end of the pressing arm 23, at a position of the end in the urging direction side of the pressing spring 15. Further the adjusting cam 26 is constituted so as to have an outer configuration as an eccentric surface with respect to the rotation center. Further, depending on a phase, the adjusting cam 26 retracted to a non-contact position with the pressing arm 23 positioned in the pressing position, and contacts and presses the pressing arm 23 to move the pressing arm 23 in a direction in which the pressing arm 23 moves against the urging force of the pressing spring 15. Such rotation of the adjusting cam 26 is controlled by driving the motor 204 by an instruction from the controller 201, so that it is possible to set the phase of the adjusting cam 26 at an arbitrary position.

Figure 7:
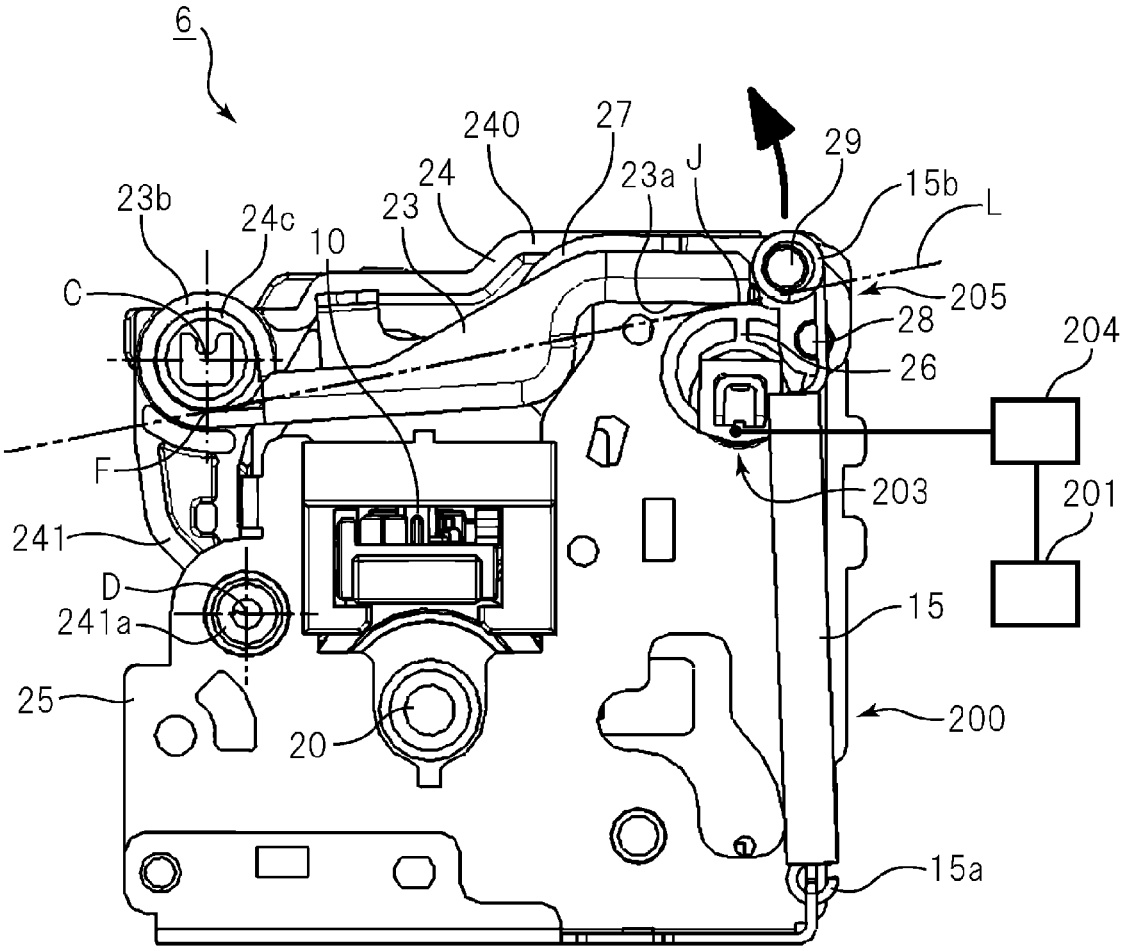
FIG. 7 is a sectional view, of the fixing device, showing a state in which a pressing force of the abutment is released (eliminated).

In this way, the adjusting cam 26 contacts the pressing arm 23 to push up the pressing arm 23 in an arrow direction in FIG. 7, so that the pressing force applied to the fixing assembly 10 is released (eliminated) or alleviated by the pressing arm 23. That is, the phase of the adjusting cam 26 is set at the position as shown in FIG. 7, the pressing arm 23 is spaced from the contact receiving portion 16*b* of the flange 16, so that the pressing force applied from the pressing arm 23 to the fixing assembly 10 is released or removed. Incidentally, even in a state in which the pressing arm 23 contacts the contact receiving portion 16*b*, the pressing force by the pressing arm 23 may also be alleviated by moving the pressing arm 23 from the above-described pressing position shown in FIG. 5. That is the pressing arm 23 pushed up by the cam 26 is spaced from at least a part of the flange 16.

Specifically, e.g., during non-operation of the image forming apparatus, in general, in order to prevent the elastic layer 22 of the opposite roller 22 from causing distortion by the pressing force from the fixing assembly 10, the nip N is not formed or a minute nip is formed under application of small pressure. For this purpose, in this embodiment, the phase of the adjusting cam 26 is adjusted at a predetermined phase so as to displace the pressing arm 23 in the arrow direction in FIG. 7 by causing the adjusting cam 26 to contact and press the pressing arm 23. As a result, the fixing assembly 10 is prevented from press-contacting the opposite roller 20 by the urging force from the pressing spring 15 or is press-contacted to the opposite roller 20 at low pressure. At this time, the urging force of the pressing spring 15 acts on one end of the pressing arm 23 to apply moment about the rotation center C of the pressing arm 23. The moment applied to the pressing arm 23 is transmitted to the outer (configuration) surface of the adjusting cam 26 contacting the pressing arm 23 at a point J, so that the urging force to be transmitted to the fixing assembly 10 is blocked or alleviated. As a result, the fixing assembly 10 is not pressed in the direction of the opposite roller 20 or is pressed toward the opposite roller 20 at small pressure.

On the other hand, during the operation of the image forming apparatus, in general, the fixing device 6 forms the nip N, and in order to fix the toner image on the recording material, the phase of the adjusting cam 26 is adjusted at the position where the adjusting cam 26 is retracted from the pressing arm 23 (FIG. 5). As a result, the urging force from the pressing spring 15 is transmitted to the fixing assembly 10, so that the fixing assembly 10 is press-contacted to the opposite roller 20 to form the nip N, and thus it becomes possible to apply heat and pressure onto the recording material passing through the nip N.

Further, when the type of the recording material to be passed through the nip N is changed, a width of the nip N (with respect to the recording material feeding direction) in some cases. For example, in the case of the thin paper, the width of the nip N is decreased to reduce the heat quantity to be applied, and in the case of thick paper, the width of the nip N is increased to increase the heat quantity to be applied. Even in such cases, the pressing force applied to the fixing assembly 10 is changed by changing the phase of the adjusting cam 26, so that it is possible to properly adjust the width of the nip N.

Here, the mechanism for fixing the openable cover 24 at the shield position in the state in which the pressing arm 23 is positioned at the pressing position was described above. On the other hand, as described above, even in the case where the pressing force from the pressing arm 23 is released or alleviated by the pressing adjusting mechanism 203, the openable cover 24 may preferably be fixed at the shield position.

For this purpose, in this embodiment, a surface 23*a*, of the pressing arm 23, contacting the adjusting cam 26 is tilted so as to satisfy the following condition. As shown in FIGS. 7 and 8, the contact position between the adjusting cam 26 and the pressing arm 23 is the point J, and the application point where the force from the pressing arm 23 acts on the openable cover 24 on the basis of the urging force G1 applied from the pressing spring 15 to the pressing arm 23 is the point F. Further, a rectilinear line passing through the points J and F is taken as a phantom line L. At this time, the phantom line L corresponds to a dynamically phantom arm. Further, on the basis of the urging force G1, reaction force received by the pressing arm 23 at the point J is G5, and reaction force received by the openable cover 24 at the application point F is G8. In this case, the above surface 23*a* is tilted relative to the phantom line L so that the moment H rotated toward the shield position about the rotation center D relative to the casing 25 is applied to the openable cover 24 by the resultant of the reaction forces G5 and G8 on the basis of the urging force G1.

In this embodiment, the pressing arm 23 is formed so that the surface 23*a* contacting the adjusting cam 26 is tilted, in the urging direction by the pressing spring 15, toward another end side (end side, i.e., the connecting portion side with the pressing 15). As a result, the surface 23*a* has an angle non-parallel to the phantom line L, so that the normal reaction received from the adjusting cam 26 at the point J generates moment, via the pressing arm 23, in the closing direction of the openable cover 24. This will be described specifically below with reference to FIG. 8. Incidentally, in the following description, in the case where moment magnitudes (values) are compared, comparison will be made in terms of an absolute value.

Figure 8:
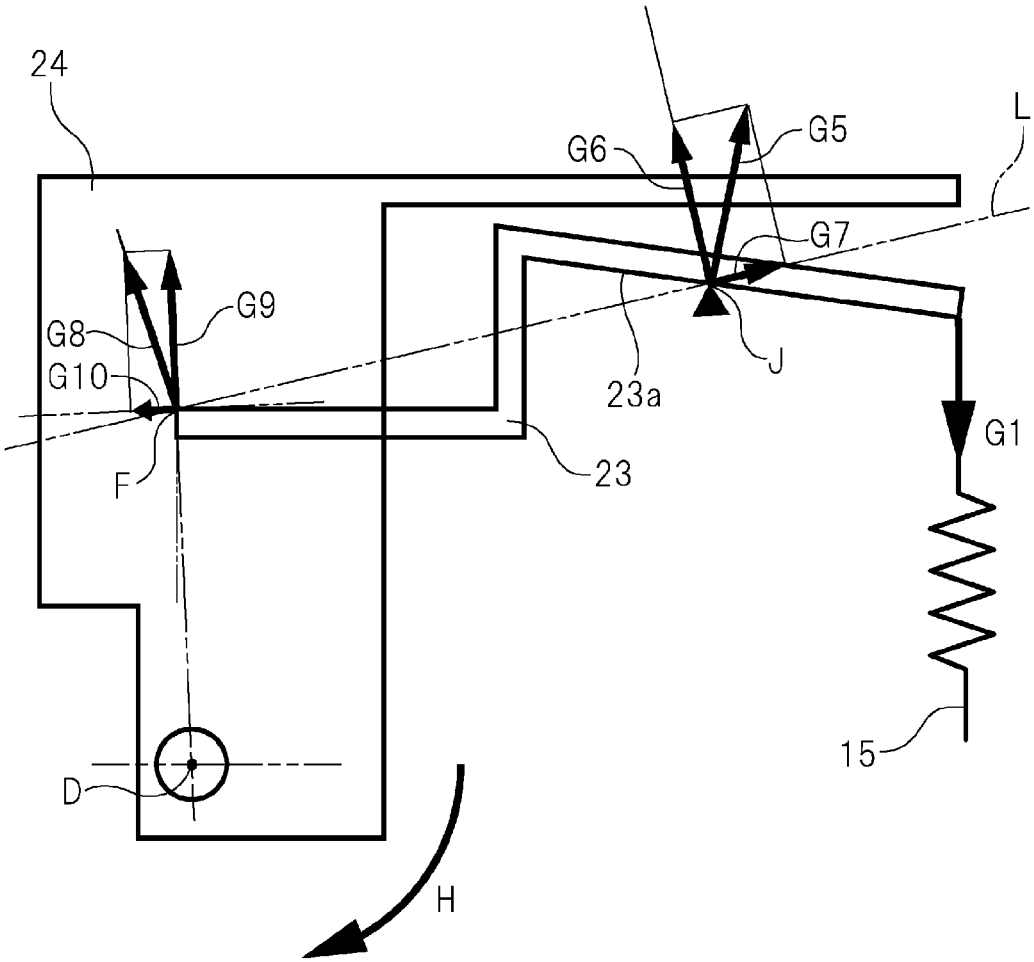
FIG. 8 is a schematic view showing action of a force in the state in which the pressing force of the pressing arm is released.

When the urging force G1 is applied to the pressing arm 23 in the arrow direction in FIG. 8 by the pressing spring 15, moment with the point J, as the fulcrum, which is the contact position between the pressing arm 23 and the adjusting cam 26 is applied to the pressing arm 23. At this time, the pressing arm 23 receives the normal reaction (reaction force) G5, from the adjusting cam 26 at the point J, directed in the arrow direction in FIG. 8. Here, with respect to the phantom line L connecting the point J and the application point F where the force acts from the pressing arm 23 onto the openable cover 24 with the point J as the fulcrum, the normal reaction G5 has an angle which is not the right angle. For this reason, the normal reaction G5 can be replaced with a force G6 perpendicular to the phantom line L and a force G7 parallel to the phantom line L. Of these two forces G6 and G7, the force G7 which is a parallel component with the phantom line L is a force for pulling in the pressing arm 23 in the G7 direction along the phantom line L. The pressing arm 23 is connected with the openable cover 24 at the point F, and therefore the pressing arm 23 is pulled in by a force G7 in the direction of the phantom line L, whereby moment acts on the openable cover 24 in the arrow D in FIG. 8 (which the same direction as the direction of the moment H) with the rotation center D as the center.

On the other hand, when the urging force G1 is applied to the pressing arm 23 in the arrow direction in FIG. 8 by the pressing spring 15, the pressing arm 23 applies an urging force G8 to the application point F on the openable cover 24 in the arrow direction in FIG. 8 with the point J as the fulcrum. The openable cover 24 is supported by the casing 25 rotatably about the rotation center D, and therefore the urging force G8 to the openable cover 24 is replaced with normal reaction G9 to the openable cover 24 and moment G10 directed in the arrow direction in FIG. 8. The openable cover 24 is constituted so as to be rotatable about the rotation center D, and therefore by the moment G10, moment directed in a direction opposite to the direction of the moment H indicated by the arrow in FIG. 8 acts on the openable cover 24.

Here, as described above, when the moment by the force G7 acting on the point J is larger than the moment G10 acting on the point F, the moment H directed in the arrow direction in FIG. 8 acts on the openable cover 24. In other words, by the resultant of the reaction force G5 at the point J and the reaction force G8 at the point F, the moment H is applied to the openable cover 24 in the direction in which the openable cover 24 is moved toward the shield position relative to the casing 25 with the rotation center D as the center. Accordingly, in this embodiment, by properly setting the position of the rotation center D and the tilt angle of the surface 23*a* of the pressing arm 23, the moment by the force G7 acting on the joint J is made larger than the moment G10 acting on the point F. As a result, the moment H acts on the openable cover 24, so that the openable cover 24 is fixed at the shield position.

In the case of this embodiment described above, even in the state in which the pressing force of the pressing arm 23 is released or alleviated, the openable cover 24 is urged in the direction of covering the opening 25*a* of the casing 25 only by connecting the pressing spring 15 with the pressing arm 23. Accordingly, in the case of this embodiment, irrespective of the operation of the pressing adjusting mechanism 203 and without separately using the fastening means for fastening the openable cover 24 to the casing 25, it is possible to fix the openable cover 24 at the shield position.

Incidentally, in the case of this embodiment, the moment G10 acting on the point F is opposite from the moment H for urging the openable cover 24 toward the shield position. This is because the rotation center D of the openable cover 24 relative to the casing 25 is disposed outside the fixing device 6 to the possible extent. That is, inside the fixing device 6, various members such as the fixing assembly 10 are disposed, and when the rotation center D is disposed in a central side of the fixing device 6, there is a possibility that a degree of freedom of design is lowered. On the other hand, by disposing the rotation center D outside the fixing device 6 to the possible extent, the influence of the rotatable portion of the openable cover 24 on arrangement of the various members in the fixing device 6 can be reduced, so that the degree of freedom of design is improved. On the other hand, when such a constitution is employed, the moment G10 acting on the point F acts in the opposite direction to the direction of the moment H as described above. However, in the case of this embodiment, by properly setting the tilt angle of the surface 23*a* of the pressing arm 23, the moment by the force G7 acting on the point J is made larger than the moment G10, with the result that the force for fixing the openable cover 24 at the shield position is provided.

By moving the rotation center D of the openable cover 24 relative to the casing 25 to a position in the point J side more than the position of FIG. 8, the moment G10 acting on the point F may also be directed in the same direction as the direction of the moment H. In this case, there is no need to make the moment by the force G7 acting on the point J larger than the moment G10, and therefore the tilt angle of the surface 23*a*, of the pressing arm 23, contacting the adjusting cam 26 with respect to the phantom line L can be made gentle. For this reason, the degree of freedom of the design of the pressing arm 23 is improved. Further, when the moment by the force G7 acting on the point J is smaller than the moment G10, the direction of the moment by the force G7 may also be opposite to the direction of the moment H.

[Release of Urging Force]

Figure 9:
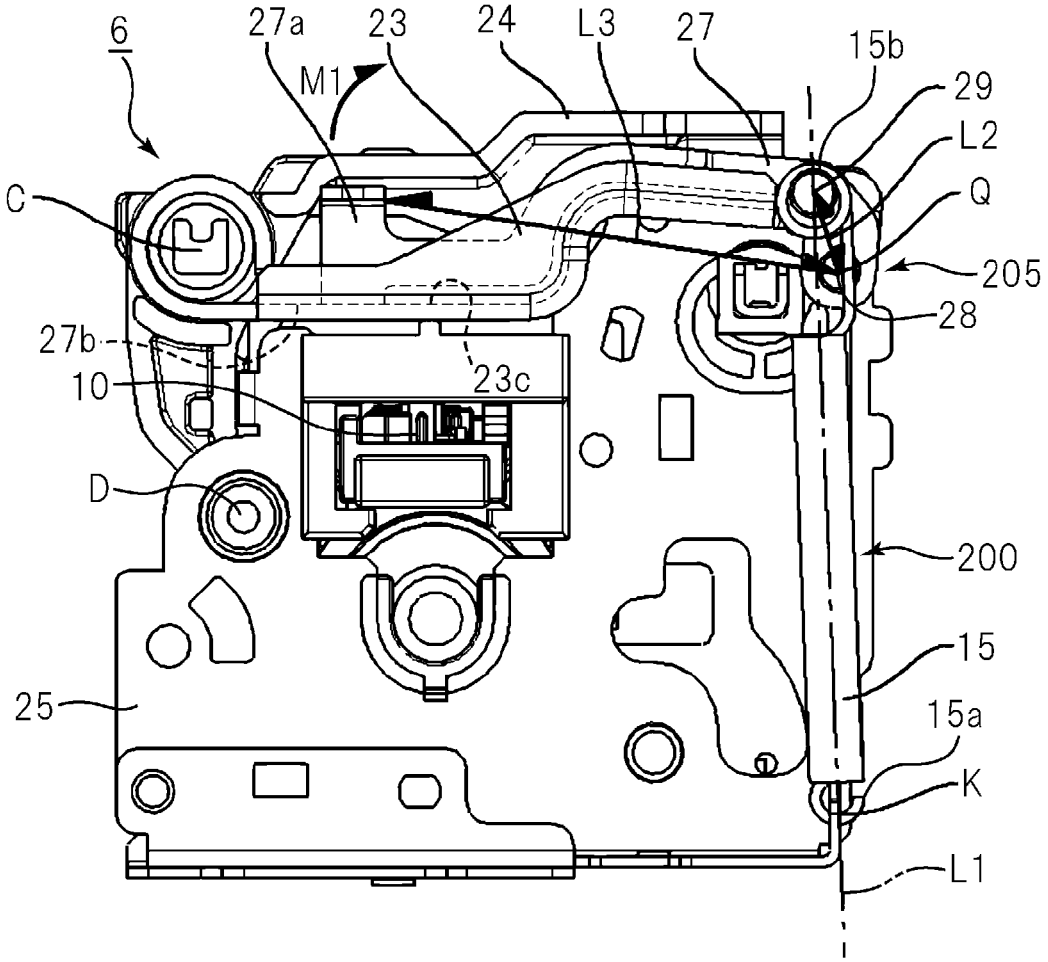
FIG. 9 is a sectional view, of the fixing device, showing a non-released state of a releasing arm.
Figure 11:
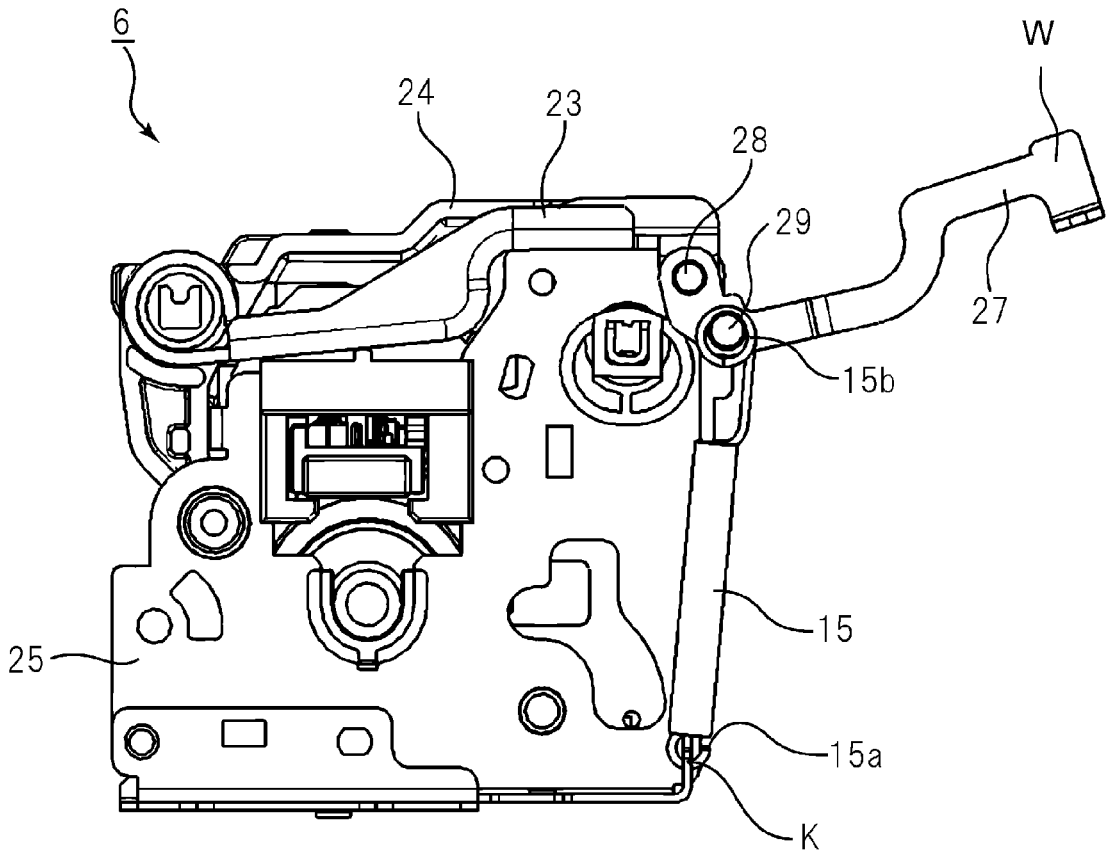
FIG. 11 is a sectional view, of the fixing device, showing a released state of the releasing arm.
Figure 12:
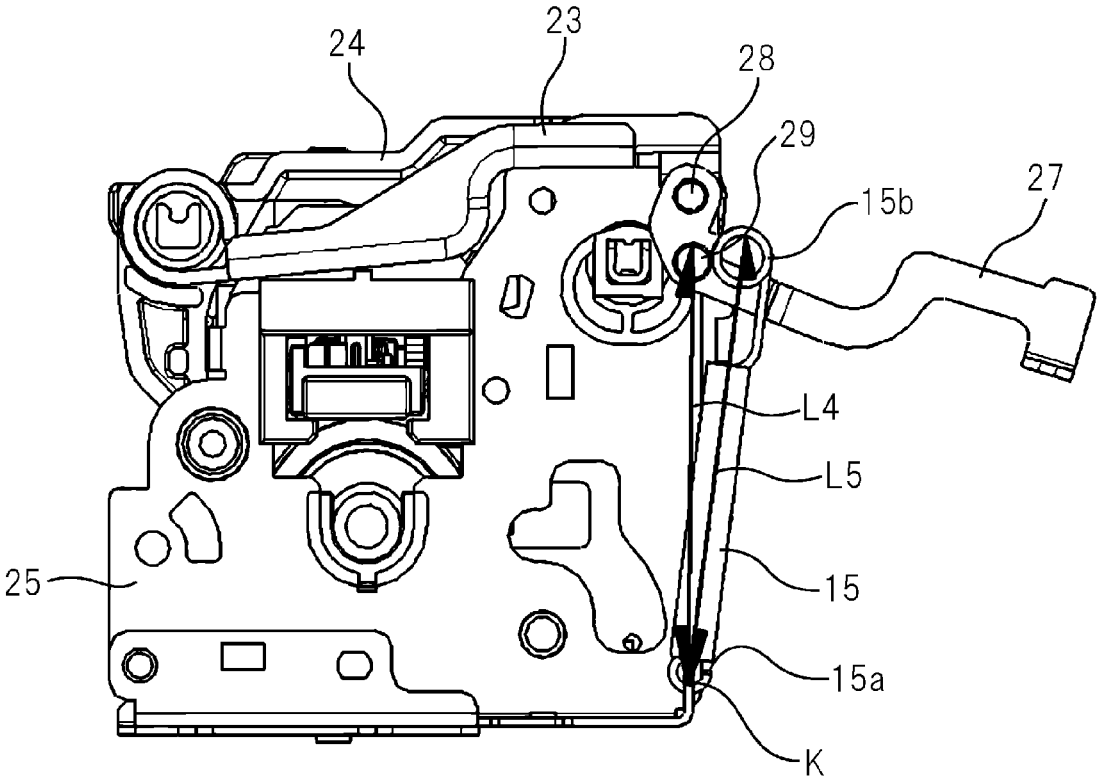
FIG. 12 is a sectional view, of the fixing device, showing a state in which a pressing spring is demounted from the releasing arm.

Next, the releasing mechanism 205 as the releasing means for releasing the urging force by the pressing spring 15 will be described with reference to FIGS. 9 and 12. The releasing mechanism 205 includes a releasing arm 27 as a rotatable portion rotatably supported by the pressing arm 23 and a projected portion (boss) 29 as a rotation-side connecting portion which is provided at a position out of a rotation center Q of the releasing arm 27 and with which the pressing spring 15 is connected. Further, on the basis of a rotational position of the releasing arm 27, the position of the projected portion 29 is set so that the pressing arm 23 can be pressed by the urging force of the pressing spring 15 and so that the urging force of the pressing spring 15 can be alleviated or released. That is, in the case where the releasing arm 27 is positioned at the pressing position shown in FIG. 9, the pressing arm 23 is pressed by the urging force of the pressing spring 15 via the releasing arm 27. On the other hand, as shown in FIG. 11 or 12, in the case where the releasing arm 27 is positioned at a releasing position where the releasing arm 27 is rotated from the pressing position by a predetermined angle, compared with the case where the releasing arm 27 is positioned at the pressing position, the urging force of the pressing spring 15 is alleviated or released. This will be described specifically below.

At another end of the pressing arm 23, the base end portion of the releasing arm 27 is connected rotatably relative to the pressing arm 23 about a rotation shaft (supporting portion) 28. The releasing arm 27 is provided with the projected portion 29, for connecting the pressing spring 15, at a position out of the rotation shaft 28, and the pressing spring 15 and the releasing arm 27 are connected with each other by hooking another end-side hooking portion 15*b*, provided at another end portion of the pressing spring 15, on the projected portion 29. Further, by hooking one end-side hooking portion 15*a*, provided at one end portion of the pressing spring 15, in the engaging hole 25*c* provided in the casing 25, the pressing spring 15 and the casing 25 are connected with each other at a connecting portion K. As a result, the urging force of the pressing spring 15 is applied to the pressing arm 23 via the releasing arm 27.

Further, the projected portion 29 of the releasing arm 27 is provided at the position out of the rotation center Q of the rotation shaft 28, so that a distance between the projected portion 29 and the connecting portion K is changed by rotating the releasing arm 27 about the rotation shaft 28. That is, by rotating the releasing arm 27 in an arrow M1 direction (releasing direction) of FIG. 9, the projected portion 29 is rotated and displaced about the rotation shaft 28. Incidentally, at a free end W of the releasing arm 27, a grip portion 27*a* for operating the releasing arm 27 during a releasing operation is provided.

Then, the distance between the projected portion 29 and the connecting portion K is decreased by the rotation of the releasing arm 27, so that another end-side hooking portion 15*b* of the pressing spring 15 is demountable from the projected portion 29 at the releasing position where the distance is equal to the natural length of the pressing spring 15 (or is less than the natural length). In other words, in the case of this embodiment, the position of the projected portion 29 is set so that the distance between the projected portion 29 and the connecting portion K (engaging hole 25*c*) is the natural length of the pressing 15 at the releasing position of the releasing arm 27.

At such a releasing position, by disconnecting the pressing spring 15 connected with the projected portion 29, the openable cover 24, the pressing arm 23 and the releasing arm 27 are integrally rotatable about the rotation center develop. Then, as described above, the fixing assembly 10 is mountable.

Figure 10:
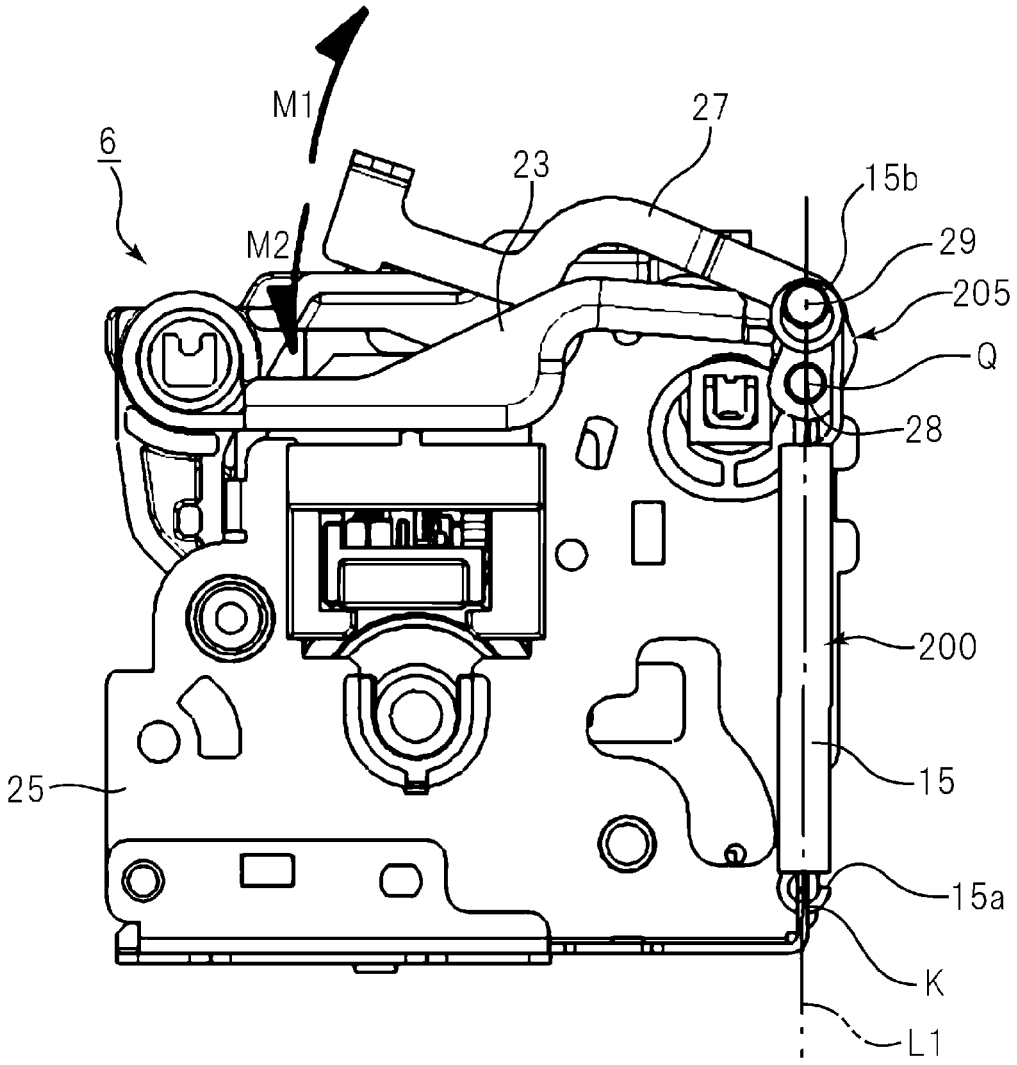
FIG. 10 is a sectional view, of the fixing device, showing an operation direction of the releasing arm.

On the other hand, by rotating the releasing arm 27 in an arrow M2 direction (non-releasing direction) of FIG. 10, the distance between the projected portion 29 and the connecting portion K is made larger than the natural length of the pressing spring 15, so that the urging force of the pressing spring 15 is applicable. At this time, the rotation of the releasing arm 27 is limited by abutment of an end contact portion 27*b* against a bottom plate portion 23*c* of the releasing arm 23 as indicated by a broken line in FIG. 9. That is, the contact portion 27*b* contacts the bottom plate portion 23*c*, so that further rotation of the releasing arm 27 relative to the pressing arm 23 in the arrow M2 direction is limited. Moreover, in this state, the urging force of the pressing 15 acts on the photosensitive drum 29, so that moment directed in the arrow M2 direction is exerted on the releasing arm 27 and thus the contact portion 27*b* contacts the bottom plate portion 23*c* with reliability. As a result, the releasing arm 27 is fixed to the pressing arm 23.

Next, the forces acting on the respective portions by the operation of the releasing arm 27 will be described more specifically. In this embodiment, each of the above-described connecting portion K, the projected portion 29 and the rotation shaft 28 is set to satisfy the following conditions. First, as described above, the releasing arm 27 is mounted to the pressing arm 23 rotatably about the rotation shaft 28 so that the releasing arm 27 is capable of being rotated and displaced along a locus shown in FIGS. 9 to 12. FIG. 9 shows a state in which the releasing arm 27 is placed in the non-releasing state (set state of the pressing spring 15). In this state, the phantom line (rectilinear line) L connecting the center of the projected portion 29, connected with the pressing spring 15 provided on the releasing arm 27, with the connecting portion K of the pressing spring 15 with the casing 25 is positioned in the non-releasing direction relative to the rotation shaft 28 of the releasing arm 27. Further, by the urging force of the pressing spring 15, moment for urging the releasing arm 27 toward the non-releasing position (set position or a predetermined position of the pressing 15) is provided.

Here, a distance L2 between the center (rotation center Q) of the rotation shaft 28 of the releasing arm 27 and the center of the projected portion 29 and a distance L3 between the center of the rotation shaft 28 and the grip portion 27*a* are set so that a sufficient lever ratio, e.g., such that L3 is 5 times L2 is provided. As a result, even when the releasing arm 27 is urged to the non-releasing position by the urging force (e.g., 300N) of the pressing 15, by using the principle of leverage, the releasing arm 27 can be rotated in the releasing direction against the urging force only by a force multiplied by the reciprocal (inverse) of the lever ratio (e.g., 5).

When the releasing arm 27 is rotated to the position of FIG. 10 in the releasing direction, the phantom line L connecting the center of the projected portion 29 with the connecting portion K passes through the center of the rotation shaft 28, and in this state, the moment for urging the releasing arm 27 toward the non-releasing position disappears. From this position as a turning point (position), when the releasing arm 27 is rotated toward the non-releasing position, moment for urging the releasing arm 27 toward the non-releasing position is applied to the releasing arm 27 by the pressing spring 15. On the other hand, when the releasing arm 27 is rotated from the above position toward the releasing direction, moment for urging the releasing arm 27 toward the releasing position is applied to the releasing arm 27 by the pressing spring 15.

Further, when the releasing arm 27 is rotated to the position of FIG. 11 in the releasing direction, the distance between the projected portion 29 and the connecting portion K is equal to the natural length of the pressing spring 15, so that in this state, the pressing force of the pressing spring 15 disappears. For this reason, the pressing spring 15 is easily demountable from the projected portion 29.

Further, when the releasing arm 27 is rotated to the position of FIG. 12, the distance between the projected portion 29 and the connecting portion K is smallest, and a distance L4 at that time is set to be shorter than a natural length L5 of the pressing spring 15. As a result, even when the distance L4 between the projected portion 2P and the connecting portion K fluctuates due to shape variation in parts and mounting accuracy, the distance L4 can be made shorter than the natural length L5 with reliability. Further, the pressing spring 15 is always in a non-load state, so that setting is made so that a demounting operation of the pressing spring 15 can be reliably performed with no load.

In the case of this embodiment, the position of FIG. 11 may be the releasing position, but in consideration of part accuracy or the like, the position of FIG. 12 may preferably be the releasing position. That is, an angle obtained by rotating the releasing arm 27 from the non-releasing position (predetermined position) of FIG. 9 to the position of FIG. 12 may preferably be taken as a predetermined angle providing the non-releasing position.

Incidentally, in the case where the pressing spring 15 is demounted from the projected portion 29, it is preferable that the urging force of the pressing spring 15 disappears. However, when the urging force of the pressing spring 15 is alleviated compared with the case where the releasing arm 27 is positioned at the predetermined position, the demounting of the pressing spring 15 becomes easy to some extent, and therefore the above-described predetermined angle can also be set at a position where the urging force of the pressing spring 15 does not disappear.

Further, in the above description, the rotation of the pressing arm 23 and the openable cover 24 is enabled by the disconnecting the another end-side hooking portion 15*b* of the pressing spring 15 from the projected portion 29. However, e.g., at the releasing position, the releasing arm 27 is made separable from the pressing arm 23, so that the releasing arm 27 and the pressing spring 15 are disconnected from the pressing arm 23 and thus the rotation of the pressing arm 23 and the openable cover 24 may also be enabled. In this case, it is possible to demount the pressing spring 15 from the pressing arm 23 while mounting the pressing spring 15 to be releasing arm 27.

Further, the pressing spring 15 may also be constituted so as to be demounted from the casing 25. That is, in a state in which the pressing spring 15 and the pressing arm 23 are connected with each other as they are, the one end-side hooking portion of the pressing spring 15 is demounted from the casing 25. In such a constitution, the urging force of the pressing spring 15 is alleviated or released, and therefore the demounting of the pressing spring 15 can be easily performed.

According to the thus-constituted this embodiment, it is possible to easily perform an exchange operation of the fixing assembly 10 by connecting the pressing arm 23 with the pressing spring 15 or by demounting the pressing arm 23 from the pressing spring 15. That is, the openable cover 24 is fixed at the shield position in the state in which the pressing arm 23 is connected with the pressing 15, and is rotatable to the open position in the state in which the pressing arm 23 is demounted from the pressing spring 15. For this reason, in the case where the fixing assembly 10 is taken out from the casing 25, the openable cover 24 can be rotated to the open position by demounting the pressing arm 23 from the pressing spring 15. At this time, also the pressing arm 23 is rotated together with the openable cover 24, and therefore only by operating either one of these members, the pressing arm 23 and the openable cover 24 are retracted from a locus of the fixing assembly 10 with respect to the demounting direction, so that the fixing assembly 10 can be easily taken out from the casing 25.

In summary, in the case of this embodiment, when the exchange operation of the fixing assembly 10, the opposite roller 20 or the like is performed, only by connection releasing the pressing spring 15 from the pressing arm 23, the moment for urging and fixing the openable cover 24 is eliminated or removed. For this reason, only by rotating the openable cover 24 to open, the pressing arm 23 rotatably connected with the openable cover 24 is retracted substantially integrally with the openable cover 24 from the locus of the fixing assembly 10 with respect to the demounting direction. Then, the opening 25*a* of the casing 25 is exposed, so that it becomes possible to perform mounting and demounting of the fixing assembly with respect to the fixing device 6 without performing the demounting of parts from the fixing device 6.

On the other hand, after the fixing assembly 10 is placed in the casing 25, the openable cover 24 is rotated together with the pressing arm 23 to the shield position, where the pressing arm 23 is connected with the pressing spring 15, so that the openable cover 24 is fixed. For this reason, without separately using the fastening means for fastening the openable cover 25, the openable cover 24 can be fixed at the shield position. As a result, also the mounting of the fixing assembly 10 into the casing 25 can be easily performed. Also the exchange operation of the opposite roller 20 can be easily performed similarly together with the fixing assembly 10.

Further, in the case of this embodiment, the pressing adjusting mechanism 203 for adjusting the pressing force by moving the pressing arm 23 is provided, and therefore even in the above-described constitution, the urging force for urging the fixing assembly 10 toward the opposite roller 20 is adjustable. As a result, during the non-operation of the fixing device 6, it is possible to suppress generation of distortion of the elastic layer 22 of the opposite roller 22 caused by the urging force from the fixing assembly 10. Further, depending on the type of the recording material and the like, the width of the nip N can be properly adjusted.

Further, in the case of this embodiment, by rotating the releasing arm 27, the urging force of the pressing spring 15 can be alleviated or released, and therefore the demounting of the pressing spring 15 from the pressing arm 23 can be easily performed by operating the releasing arm 27. As a result, in the case where the exchange operation of the fixing assembly 10 and the opposite roller 20 is performed, it becomes possible to simply demount (connection-release) the pressing spring 15 from the pressing arm 23 without using a tool or the like.

As described above, in this embodiment, when the exchange operation of the fixing assembly 10 or the like is performed, an opening and closing operation of the openable cover 24 can be easily performed. Particularly, there is no need to perform a mounting and demounting operation of parts such as a fastening means for fastening the openable cover 24. Further, there is no need to use the tool for performing the mounting and demounting of the pressing spring 15. For this reason, a time required for the exchange operation can be shortened, and therefore a downtime of the image forming apparatus can be shortened, so that convenience is improved. Further, the exchange operation becomes easy, and therefore mounting of the parts can be performed with high accuracy.

<Other Embodiments>

In the above-described embodiment, as the fixing device, the constitution of a combination of the fixing film with the opposite roller was described, but the present invention is not limited thereto. For example, as the rotatable member constituting the fixing device, even when a fixing roller including therein a heater or a heating belt to be heated by electromagnetic induction heating is used, the present invention is similarly applicable.

Further, as the member demounted from and mounted in the casing, not only the fixing film (fixing assembly) but also the opposite roller may be used.

Further, either one of the fixing film and the opposite roller may only be required to be pressed toward another one of the members.

Further, as the urging means, a constitution other than the tension spring described above may also be employed. For example, a compression spring for urging the pressing member by an elastically restoring force directed from an elastically compressed state to an extension direction may also be employed.

Further, the pressing adjusting means may also have a constitution other than the constitution using the cam as described above if the pressing member is moved in the constitution. For example, by using a rack and a pinion, the rotational force of the motor is converted into a force directed in a linear direction, so that the pressing member may also be moved by this linear direction force.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 045096/2013, 045097/2013 and 045098/2013 filed Mar. 7, 2013, Mar. 7, 2013 and Mar. 7, 2013, respectively, which are hereby incorporated by reference.

What is claimed is:

1. An image heating apparatus comprising:

(i) first and second rotatable members configured to form a nip for heating of a toner image on a sheet;

(ii) a first unit configured to rotatably hold said first rotatable member (iii) a second unit configured to rotatably hold said second rotatable member; and (iv) a pressing mechanism configured to press said first unit toward said second unit, wherein said pressing mechanism comprises:

(iv-i) an abutting member capable of abutting against said first unit;

(iv-ii) an arm member, including a supporting portion configured to be rotatably supported by said abutting member, capable of abutting against said abutting member; and (iv-iii) a spring member which is fixed to said second unit at one end portion thereof and which is mounted, at another end portion thereof, to said arm member at a position closer to a free end of said arm member than said supporting portion of said arm member.

2. An image heating apparatus according to claim 1, further comprising a cover member configured to (a) open and close an opening for permitting a mounting operation and a demounting operation of said first unit and (b) rotatably support said arm member in a predetermined angle range, wherein said cover member is openable by demounting said another end portion of said spring member from said arm member.

3. An image heating apparatus according to claim 2, wherein said arm member further includes a projected portion provided at the position, and said spring member includes a hooking portion, provided at said another end portion, hooked on said projected portion.

4. An image heating apparatus according to claim 3, wherein said spring member includes a coil spring, and said arm member is rotatable to a position where said coil spring has a natural length.

5. An image heating apparatus according to claim 3, wherein said hooking portion has a loop shape.

6. An image heating apparatus according to claim 2, wherein said abutting member includes a stopper configured to limit rotation of said abutting member relative to said cover member to a position exceeding the predetermined angle range.

7. An image heating apparatus according to claim 2, wherein when said first unit is pressed toward said second unit by said pressing mechanism, said image heating apparatus further comprises a spacing mechanism configured to space said abutting member from at least a part of said first unit against an urging force of said spring member.

8. An image heating apparatus according to claim 7, wherein said first unit includes a supporting member configured to rotatably support said first rotatable member, and said abutting member presses said first rotatable member toward said second rotatable member by abutting against said supporting member.

9. An image heating apparatus according to claim 8, wherein said spacing mechanism includes a cam configured to space said abutting member from at least a part of said supporting member.

10. An image heating apparatus according to claim 7, wherein said first rotatable member is an endless belt, and said second rotatable member rotationally drives said endless belt.

11. An image heating apparatus according to claim 10, further comprising a heating mechanism configured to heat said endless belt.

12. An image heating apparatus according to claim 1, wherein said spring member includes a coil spring.

13. An image heating apparatus according to claim 12, wherein said arm member is rotatable to a position where said coil spring has a natural length.

14. An image heating apparatus according to claim 1, wherein said arm member includes a grip portion provided at the free end.

15. An image heating apparatus comprising:

(i) first and second rotatable members configured to form a nip for heating of a toner image on a sheet;

(ii) a first unit configured to rotatably hold said first rotatable member;

(iii) a second unit configured to rotatably hold said second rotatable member; and (iv) a pressing mechanism configured to press each of longitudinal end portions of said first unit toward said second unit, wherein said pressing mechanism comprises:

(iv-i) a first abutting member capable of abutting against one of the longitudinal end portions of said first unit;

(iv-ii) a first arm member, including a first supporting portion configured to be rotatably supported by said first abutting member, capable of abutting against said first abutting member;

(iv-iii) a first spring member which is fixed to said second unit at one end portion thereof and which is mounted, at another and portion thereof, to said first arm member at a position closer to a free end of said first arm member than said first supporting portion of said first arm member;

(iv-iv) a second abutting member capable of abutting against another one of the longitudinal end portions of said first unit;

(iv-v) a second arm member, including a second supporting portion configured to be rotatably supported by said second abutting member, capable of abutting against said second abutting member; and (iv-vi) a second spring member which is fixed to said second unit at one end portion thereof and which is mounted, at another end portion thereof, to said second arm member at a position closer to a free end of said second arm member than said first supporting portion of said second arm member.

16. An image heating apparatus according to claim 15, further comprising a cover member configured to (a) open and close an opening for permitting a mounting operation and a demounting operation of said first unit and (b) rotatably support said first and second arm members in a predetermined angle range, wherein said cover member is constituted so as to be openable by demounting said another end portion of said first and second spring members from said arm members, respectively.

17. An image heating apparatus according to claim 16, wherein said abutting member includes a stopper configured to limit rotation of said first and second abutting members relative to said cover member to a position exceeding the predetermined angle range.

18. An image heating apparatus according to claim 16, further comprising a spacing mechanism configured to space said first and second abutting members from at least a part of said first unit against urging forces of said first and second spring members, respectively.

19. An image heating apparatus according to claim 15, wherein each of said first and second spring members includes a coil spring, and each of said first and second arm members is rotatable to a position where the associated coil spring has a natural length.

* * * * *